US011525251B2

(12) United States Patent
Wu

(10) Patent No.: US 11,525,251 B2
(45) Date of Patent: Dec. 13, 2022

(54) RECIPROCATING PUMP-TYPE PIPE DREDGING DEVICE

(71) Applicant: Kuei-Kun Wu, Kaohsiung (TW)

(72) Inventor: Kuei-Kun Wu, Kaohsiung (TW)

( * ) Notice: Subject to any disclaimer, the term of this patent is extended or adjusted under 35 U.S.C. 154(b) by 0 days.

(21) Appl. No.: 17/105,961

(22) Filed: Nov. 27, 2020

(65) Prior Publication Data

US 2022/0170250 A1 Jun. 2, 2022

(51) Int. Cl.
*E03C 1/308* (2006.01)

(52) U.S. Cl.
CPC ..... *E03C 1/308* (2013.01)

(58) Field of Classification Search
CPC . E03C 1/30; E03C 1/304; E03C 1/306; E03C 1/308; F04B 33/00; F04B 9/14
See application file for complete search history.

(56) References Cited

U.S. PATENT DOCUMENTS 1,476,969 A * 12/1923 Howard ..... E03F 9/00 285/148.23
2,001,230 A * 5/1935 Wayne ..... E03C 1/306 4/255.04
2,697,842 A * 12/1954 Meyer ..... F04B 9/14 4/255.02
4,186,451 A * 2/1980 Ruo ..... E03C 1/308 4/255.02
5,156,538 A * 10/1992 Lee ..... E03C 1/308 417/236
5,537,694 A * 7/1996 Davenport ..... E03C 1/306 4/255.05
6,550,074 B1 * 4/2003 Allenbaugh ..... E03C 1/308 4/255.05
6,895,606 B2 * 5/2005 Walsh ..... E03D 9/00 4/255.02
2010/0132102 A1 * 6/2010 Flamand ..... E03D 11/00 4/255.11
2014/0075661 A1 * 3/2014 Zeng ..... E03C 1/302 4/255.11

FOREIGN PATENT DOCUMENTS

CN 204662597 U 9/2015

* cited by examiner

*Primary Examiner* — David P Angwin
*Assistant Examiner* — Nicholas A Ros
(74) *Attorney, Agent, or Firm* — Muncy, Geissler, Olds & Lowe, P.C.

(57) ABSTRACT

A reciprocating pump-type pipe dredging device comprises an inflator and a pipe dredging portion detachably assembled with the inflator. The inflator includes a cylinder, an inflator handle and a first assembly portion. The pipe dredging portion includes a suction disc and a flexible pipe. The suction disc includes a second assembly portion joined with the first assembly portion, a disc connected to one end of the second assembly portion, and a third assembly portion extending toward an inner top end of the disc and corresponding to the second assembly portion. The flexible pipe includes a pipe and a plurality of layered flexible ring plates. One end of the pipe is provided with a fourth assembly portion joined with the third assembly portion, and the inflator and the pipe dredging portion are formed a continuous passage thereinside after assembling.

5 Claims, 13 Drawing Sheets

RECIPROCATING PUMP-TYPE PIPE DREDGING DEVICE

FIELD OF THE INVENTION

The invention relates to a pipe cleaner, and more particularly to a reciprocating pump-type pipe dredging device.

BACKGROUND OF THE INVENTION

As shown in FIG. 1, FIG. 2 and FIG. 3, a drainage pipeline 13 is generally provided with a bent pipe 131 in different environments. The drainage pipeline 13 is in a toilet as an example, when the bent pipe 131 of the drainage pipeline 13 in the toilet is blocked by blockages 132 and cannot drain water normally. In order to tackle the blockage, users use a toilet and pipeline dredging washer disclosed by Chinese Publication No. CN 204662597 U, wherein a dredging device 1 is used to dredge the drainage pipeline 13. The dredging device 1 includes a flexible rod 11 and a dredge head 12. The flexible rod 11 includes a grip 111 and a first embedding portion 112 opposite to one end of the grip 111. The grip 111 is provided for a user to hold with a hand and manipulate the flexible rod 11. The dredge head 12 includes a protruding rod 121, a second embedding portion 122 disposed at one end of the protruding rod 121 and assembled with the first embedding portion 112, and a plurality of flexible plates 123 disposed at intervals at one end of the protruding rod 121 opposite to one end of the second embedding portion 122.

As shown in FIG. 3, when the bent pipe 131 of the drainage pipeline 13 is blocked by the blockages 132, the dredge head 12 of the dredging device 1 is inserted into the bent pipe 131 along the bent pipe 131 of the drainage pipeline 13, the user holds the grip 111 with a hand to perform repeated motions to apply pressure to interiors of the drainage pipeline 13 and the bent pipe 131 (as shown by a dotted arrow in FIG. 3), so that the dredge head 12 pushes the blockages 132 to achieve an effect of dredging the drainage pipeline 13. However, a pressure of the dredging device 1 is not strong in view of the repeated motions of the plurality of flexible plates 123 so that a pressure for pushing the blockages 132 blocked at a deepest part of the bent pipe 131 may be too small, consequently, the drainage pipeline 13 and the bent pipe 131 cannot be smoothly dredged. In addition, since the plurality of flexible plates 123 are not tightly attached to an inner wall of the bent pipe 131, the user cannot pressurize smoothly by holding the grip 111 with a hand to perform repeated motions, and thus the dredging device 1 is extremely laborious and time-consuming in use. In addition, some manufacturers have developed another dredging device 2 as shown in FIG. 4 and FIG. 5, and the dredging device 2 includes an inflator 21 and a suction disc 22. The suction disc 22 includes a joining portion 221 assembled at one end of the inflator 21, and a suction portion 222 extending from one end of the joining portion 221. When the suction portion 222 of the dredging device 2 is placed to face an outer periphery of a pipe opening 230 of a drainage pipeline 23 in a toilet for example, the user holds the inflator 21 with a hand to perform repeated motions to the drainage pipeline 23 and a bent pipe 231 disposed inside the drainage pipeline 23, and apply pressure to an interior of the drainage pipeline 23 and the bent pipe 231 to transport air into the interior of the bent pipe 231 to push blockages 232 to achieve an effect of dredging the drainage pipeline 23. Air pressure provided by the dredging device 2 through repetitive motions of the inflator 21 is very large, but because a shape of contact between the suction portion 222 of the suction disc 22 and the pipe opening 230 of the drainage pipeline 23 of the toilet is arcuate, a suction surface of the suction portion 222 is relatively uneven, which not only makes an air pressure of repeated motions of the inflator 21 uneven, but also causes a part of the air (shown by a dotted arrow in FIG. 5) to rush back to the inside of the suction disc 22, and a gap 223 being formed between the suction portion 222 of the suction disc 22 and the pipe opening 230, resulting in the air leaking out through the gap 223. The dredging device 2 will not only cause insufficient air pressure of repetitive motions of the inflator 21, but also cannot smoothly pressurize and dredge the blockages 232 inside the drainage pipeline 23. Therefore, the dredging device 2 includes the above-mentioned drawbacks and needs further improvement.

SUMMARY OF THE INVENTION

A main object of the invention is to solve the problems derived from structural deficiencies of the existing dredging devices.

In order to achieve the above-mentioned object, the invention provides a reciprocating pump-type pipe dredging device comprising an inflator and a pipe dredging portion detachably assembled with the inflator. The inflator includes a cylinder with a hollow, an inflator handle connected to one end of the cylinder to push air into the hollow of the cylinder, and a first assembly portion disposed at one end of the cylinder opposite to the inflator handle, and the first assembly portion is provided with a first opening communicating with the hollow of the cylinder. The pipe dredging portion includes a suction disc and a flexible pipe, wherein the suction disc includes a second assembly portion joined with the first assembly portion, a disc connected to one end of the second assembly portion, and a third assembly portion extending toward an inner top end of the disc and corresponding to the second assembly portion, and a passage is formed between interiors of the second assembly portion and the third assembly portion. The flexible pipe includes a pipe and a plurality of layered flexible ring plates, the pipe includes a space and a fourth assembly portion corresponding to one end of the pipe and joined with the third assembly portion, the fourth assembly portion is provided with a second opening communicating with the space of the pipe, the second opening communicates with the passage and the first opening of the first assembly portion, the pipe is provided with a third opening at an end opposite to the second opening, and the third opening communicates with the space of the pipe and the second opening, thereby the inflator and the pipe dredging portion are formed a continuous passage thereinside after assembling, and the plurality of layered flexible ring plates are disposed intervally on an outer periphery of an end of the pipe and adjacent to the end of the pipe opposite to the fourth assembly portion.

Further, an external screw thread is provided on an outer periphery of the first assembly portion, wherein an inner wall of the passage forms an internal screw thread to be correspondingly screwed with the external screw thread of the first assembly portion.

Further, an outer periphery of the fourth assembly portion is provided with an external screw thread to be correspondingly screwed with the internal screw thread of the inner wall of the passage of the third assembly portion, so that the fourth assembly portion is connected and abutted with the first assembly portion.

Further, outer diameters of the plurality of layered flexible ring plates are tapered from an upper layer to a lower layer adjacent to an end of the pipe opposite to the fourth assembly portion.

Further, an outer diameter of the disc is larger than the outer diameters of the plurality of layered flexible ring plates.

Compared with the prior art, the above-mentioned disclosure of the invention has the following features: in the reciprocating pump-type pipe dredging device, the second assembly portion of the suction disc is correspondingly connected with the first assembly portion of the inflator, so that the core of the second assembly portion communicates with the core of the first assembly portion, and the fourth assembly portion of the pipe is correspondingly connected with the third assembly portion of the suction disc, so that the core of the fourth assembly portion communicates with the core of the third assembly portion, and the inflator can be disassembled and assembled with the pipe dredging portion. The core of the inflator and the pipe dredging portion after assembling is the continuous passage, such that the user can choose install the suction disc and the flexible pipe to seal the drainage pipeline according to different environments, or choose only install the suction disc when the flexible pipe cannot be inserted into the drainage pipeline to achieve a dredging effect.

DETAILED DESCRIPTION OF THE PREFERRED EMBODIMENTS

The detailed description and technical contents of the invention are described below with reference to the drawings.

Figure 1:
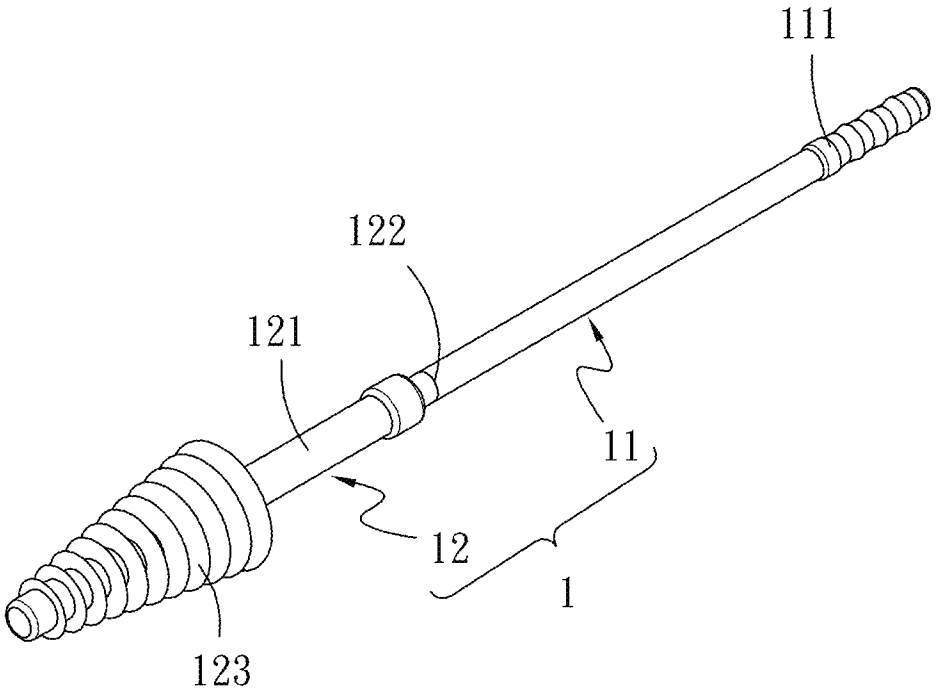
Fig.1 PRIOR ART
FIG. 1 is a perspective view of an conventional dredging device.
Figure 2:
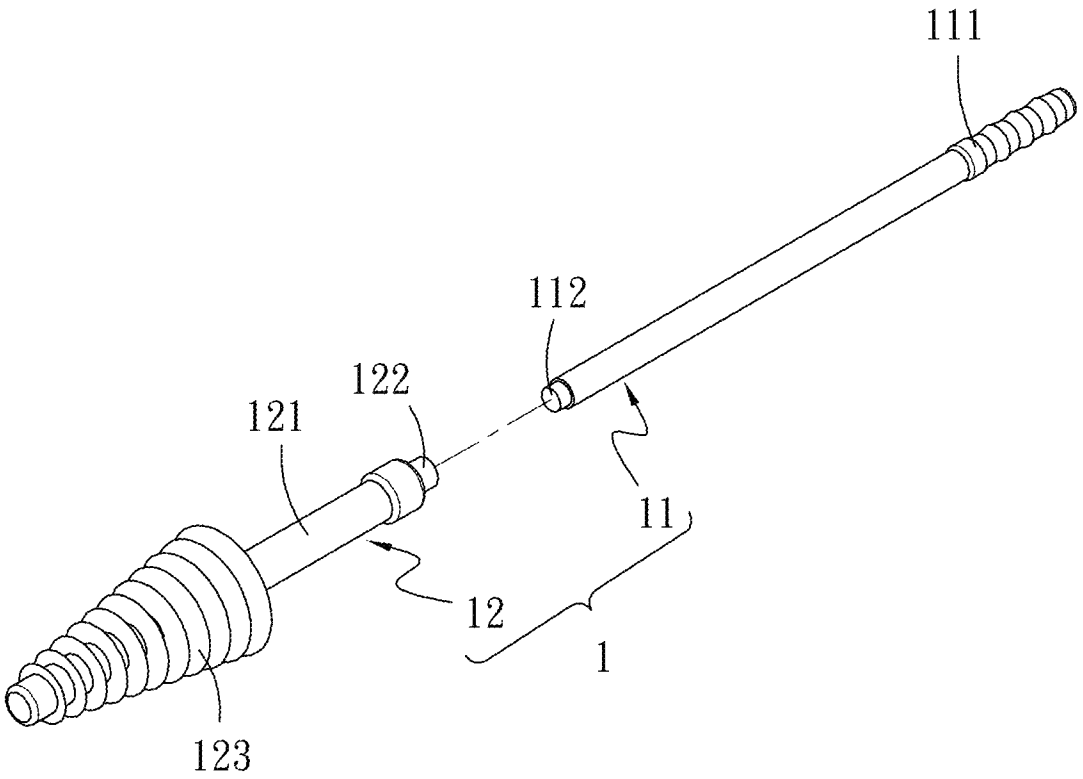
Fig.2 PRIOR ART
FIG. 2 is a exploded view of the dredging device of FIG. 1.
Figure 3:
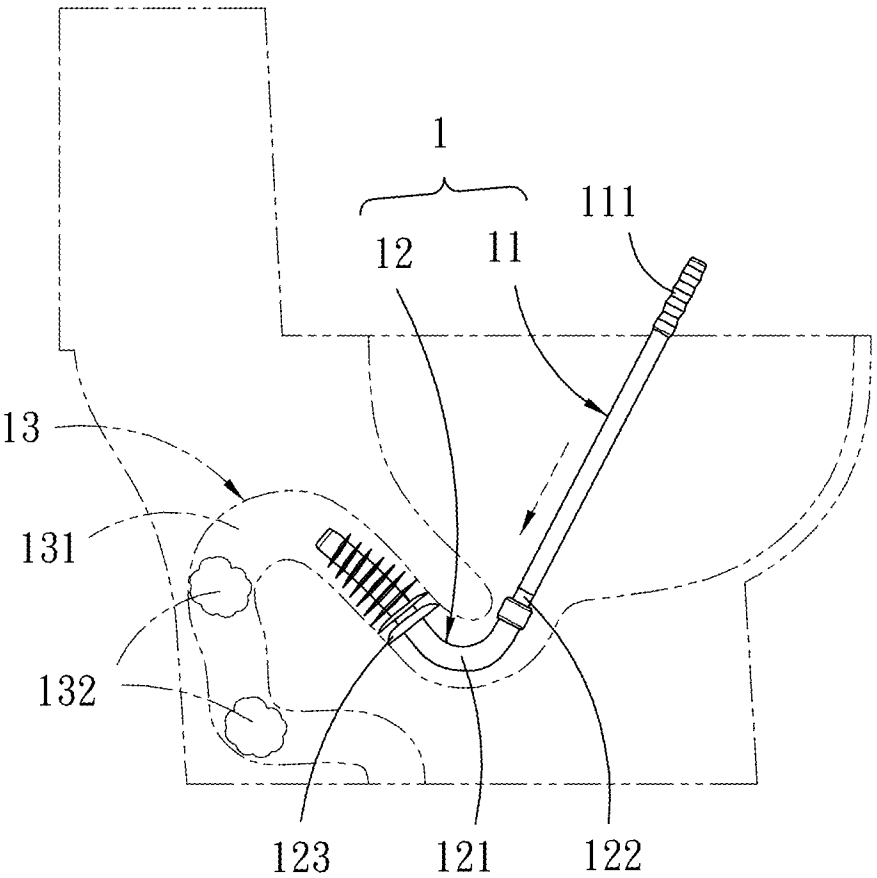
Fig.3 PRIOR ART
FIG. 3 is a schematic diagram of the dredging device of FIG. 1 dredging a toilet.
Figure 4:
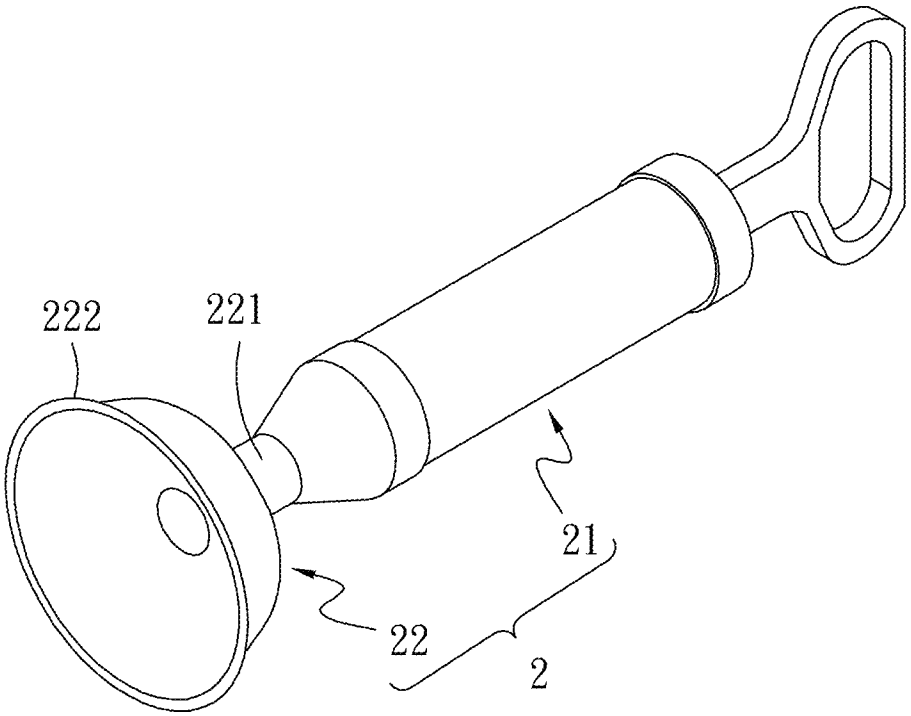
Fig.4 PRIOR ART
FIG. 4 is a perspective view of another conventional dredging device.
Figure 5:
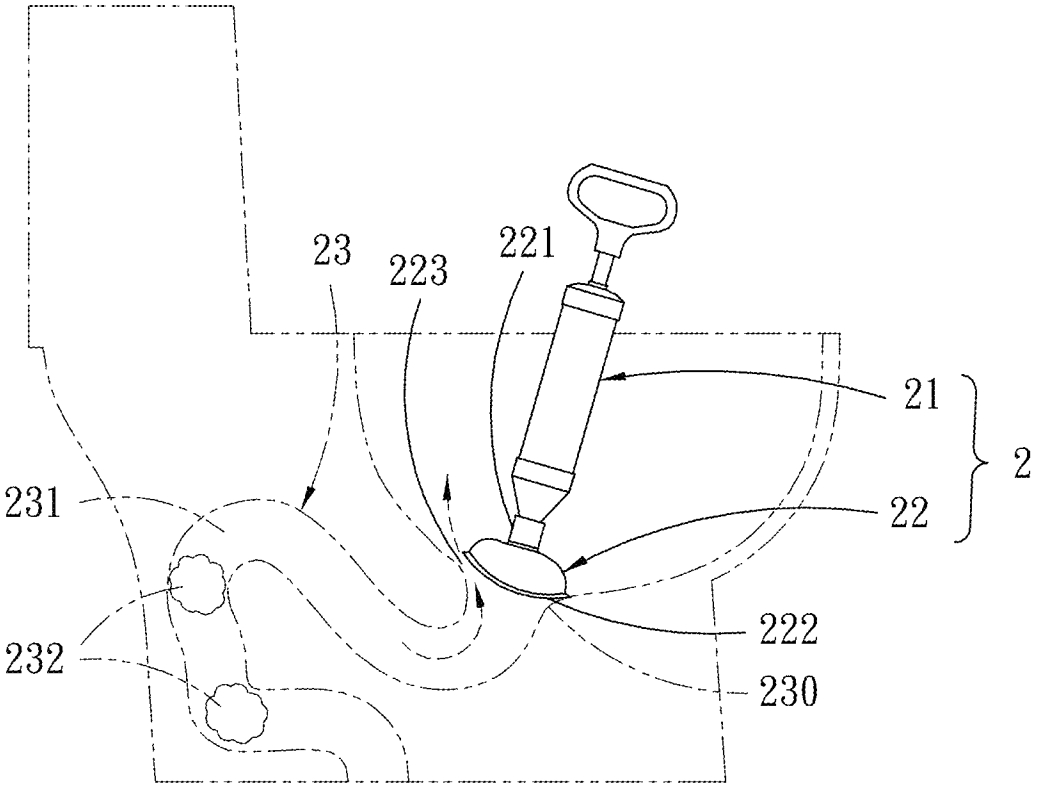
Fig.5 PRIOR ART
FIG. 5 is a schematic diagram of the dredging device of FIG. 4 dredging a toilet.
Figure 6:
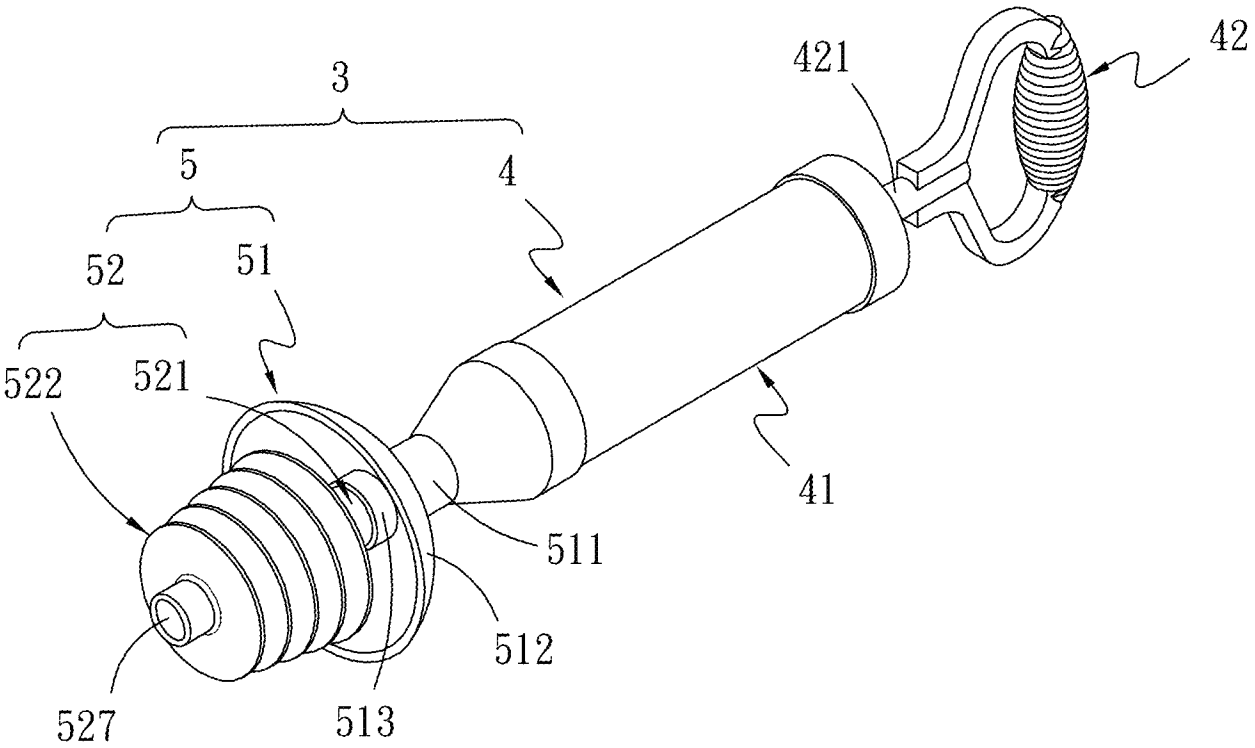
FIG. 6 is a perspective view of a reciprocating pump-type pipe dredging device of the invention.
Figure 7:
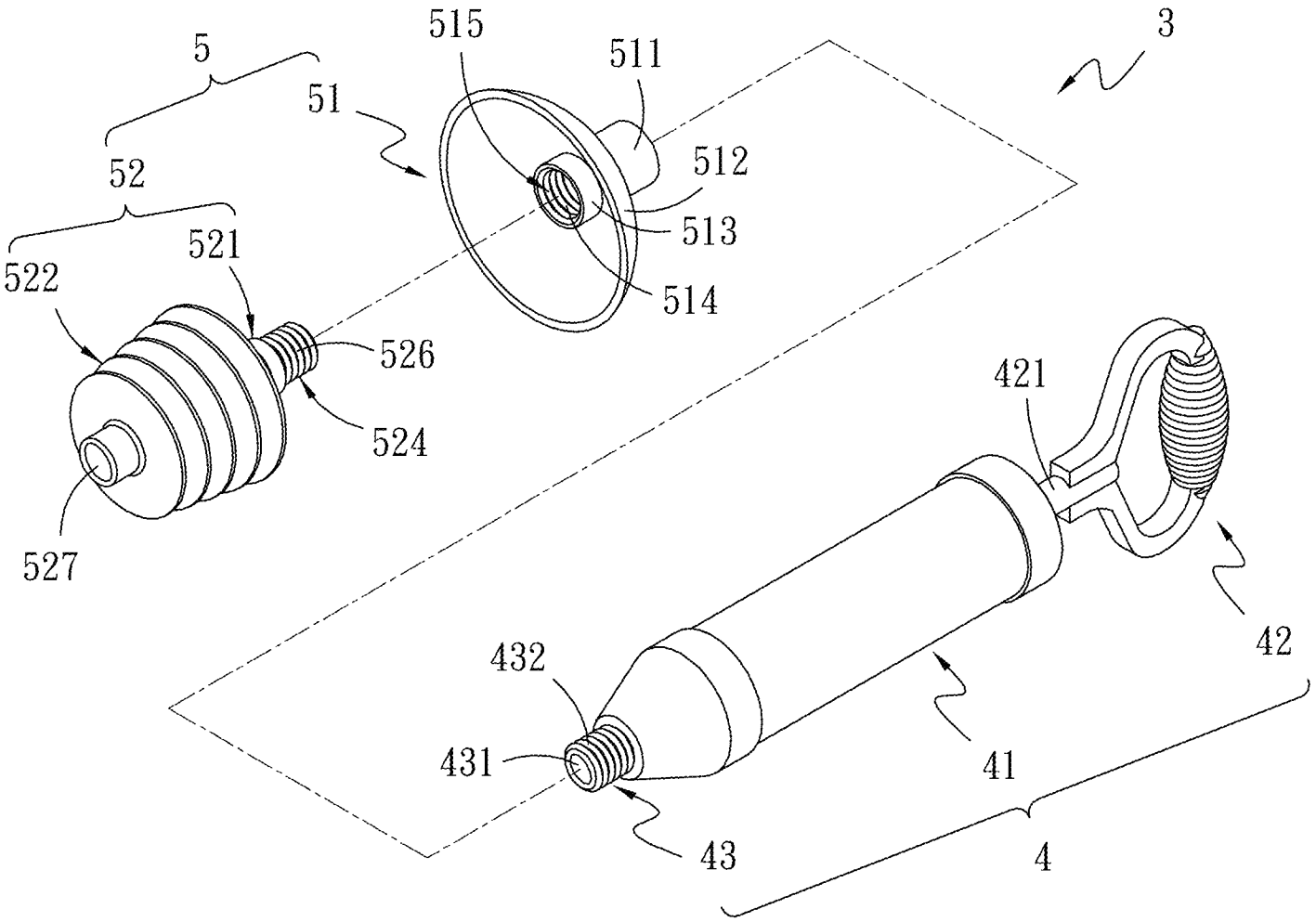
FIG. 7 is a exploded view of the reciprocating pump-type pipe dredging device of FIG. 6.
Figure 8:
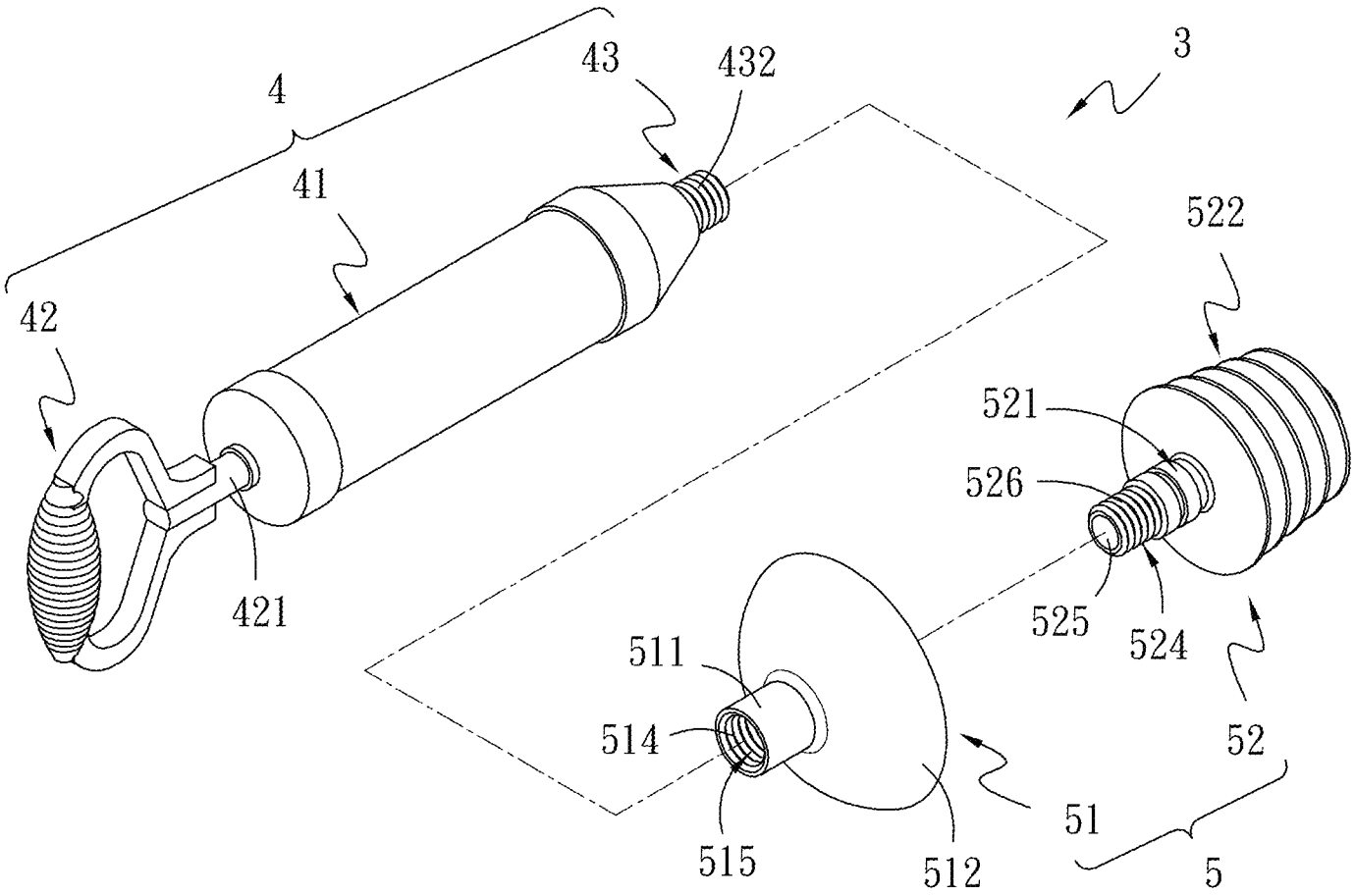
FIG. 8 is a exploded view of the reciprocating pump-type pipe dredging device of FIG. 7 viewed from another angle.
Figure 9:
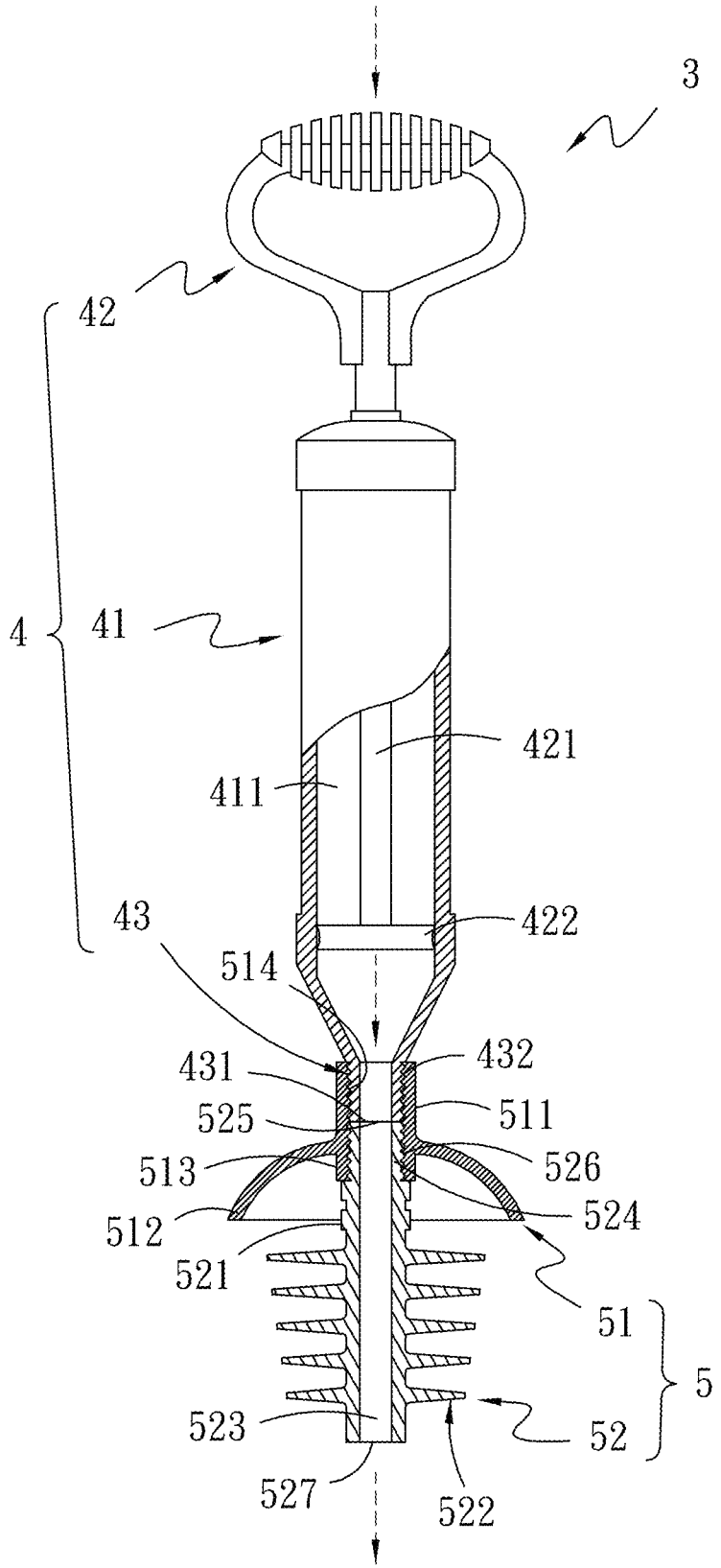
FIG. 9 is a partial cross-sectional view of the reciprocating pump-type pipe dredging device of FIG. 6.
Figure 10:
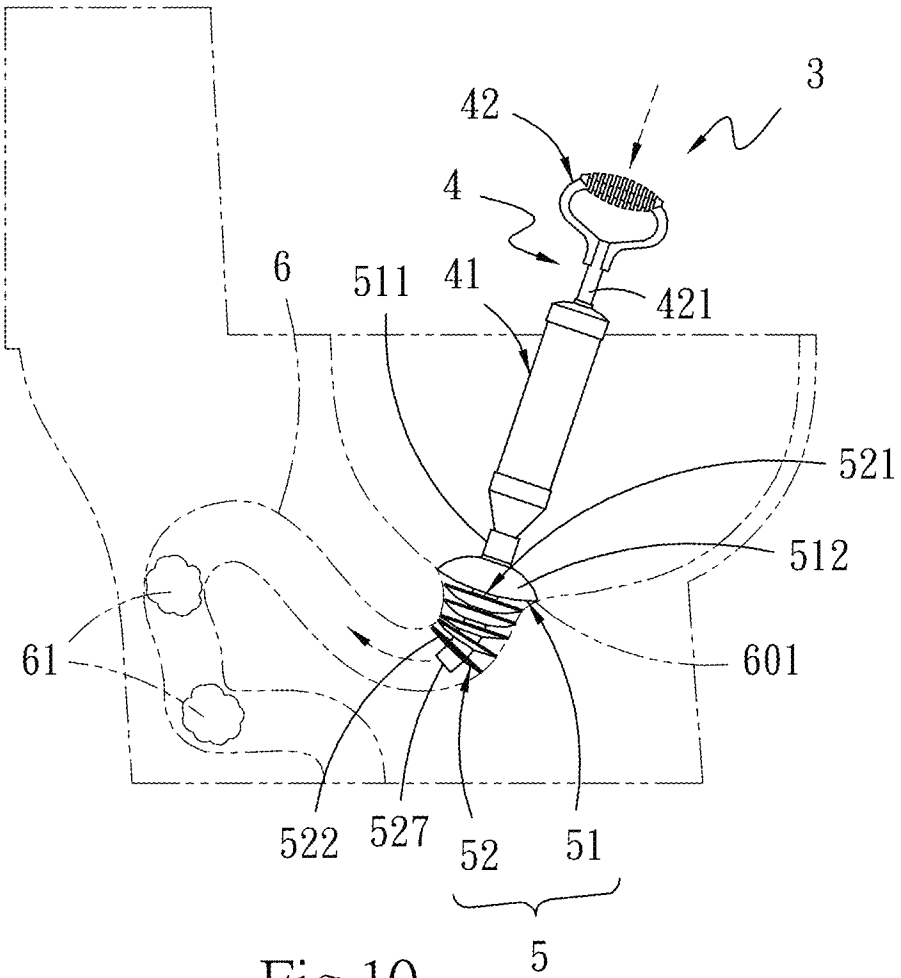
FIG. 10 is a schematic diagram of the reciprocating pump-type pipe dredging device of FIG. 6 dredging a toilet.

Please refer to FIG. 6, FIG. 7 and FIG. 8 in conjunction with FIG. 9 and FIG. 10. The invention provides a reciprocating pump-type pipe dredging device 3 which comprises an inflator 4 and a pipe dredging portion 5 detachably assembled with the inflator 4. The inflator 4 includes a cylinder 41 with a hollow 411, an inflator handle 42 connected to one end of the cylinder 41 to push air into the hollow 411 of the cylinder 41, and a first assembly portion 43 disposed at one end of the cylinder 41 opposite to the inflator handle 42. The inflator handle 42 includes a push rod 421 connected to one end of the inflator handle 42 and penetrated into the hollow 411 of the cylinder 41, and a plug 422 connected to one end of the push rod 421 opposite to the inflator handle 42. The first assembly portion 43 is provided with a first opening 431 communicating with the hollow 411 of the cylinder 41. An external screw thread 432 is provided on an outer periphery of the first assembly portion 43. The pipe dredging portion 5 includes a suction disc 51 and a flexible pipe 52. The suction disc 51 includes a second assembly portion 511 joined with the first assembly portion 43, a disc 512 connected to one end of the second assembly portion 511, and a third assembly portion 513 extending toward an inner top end of the disc 512 and corresponding to the second assembly portion 511. A passage 515 is formed between interiors of the second assembly portion 511 and the third assembly portion 513, wherein an inner wall of the passage 515 forms an internal screw thread 514 to be correspondingly screwed with the external screw thread 432 of the first assembly portion 43. The flexible pipe 52 includes a pipe 521 and a plurality of layered flexible ring plates 522. The pipe 521 includes a space 523 and a fourth assembly portion 524 corresponding to one end of the pipe 521 and joined with the third assembly portion 513. The fourth assembly portion 524 is provided with a second opening 525 communicating with the space 523 of the pipe 521, and the second opening 525 communicates with the passage 515 and the first opening 431 of the first assembly portion 43. An outer periphery of the fourth assembly portion 524 is provided with an external screw thread 526 to be correspondingly screwed with the internal screw thread 514 of the inner wall of the passage 515 of the third assembly portion 513, so that the fourth assembly portion 524 is connected and abutted with the first assembly portion 43. The pipe 521 is provided with a third opening 527 at an end opposite to the second opening 525, and the third opening 527 communicates with the space 523 of the pipe 521 and the second opening 525, thereby the inflator 4 and the pipe dredging portion 5 are formed with a continuous passage thereinside after assembling. The plurality of layered flexible ring plates 522 are disposed intervally on an outer periphery of an end of the pipe 521 and adjacent to the end of the pipe 521 opposite to the fourth assembly portion 524.

In one embodiment, outer diameters of the plurality of layered flexible ring plates 522 are sequentially decreased layer by layer from an end of the pipe 521 adjacent to the fourth assembly portion 524. An outer diameter of the disc 512 is larger than the outer diameters of the plurality of layered flexible ring plates 522. Through the continuous passage of the reciprocating pump-type pipe dredging device 3 formed by interiors of the inflator 4 and the pipe dredging portion 5 after being assembled, and pumping air into the hollow 411 of the cylinder 41 by and the push rod 421 at one end of the inflator handle 42, the air is entered from the first opening 431 of the first assembly portion 43 through the space 523 and the third opening 527 of the pipe 521 of the pipe dredging portion 5. Thereby users may install the flexible pipe 52 which is flexible and capable of tightly sealing in the pipe dredging portion 5, or only use the suction disc 51 when the flexible pipe 52 is unable to be inserted into a drainage pipeline 6 to achieve a dredging effect, according to actual demands of the drainage pipeline 6 in different environments. The reciprocating pump-type pipe dredging device 3 of the invention is capable of tightly sealing an inside of the drainage pipeline 6 through the flexible pipe 52, and the suction disc 51 sucked on a pipe opening 601 of the drainage pipeline 6 when the inflator is pressed downward to compress suction force of the suction disc 51 so as to improve an air tightness and enhance an effect of dredging the drainage pipeline 6.

Embodiments of the invention are described hereunder.

Please refer to FIG. 9 and FIG. 10, when a user uses the reciprocating pump-type pipe dredging device 3 to dredge or clear blockages 61 in the drainage pipeline 6 of a toilet, the user may hold the inflator handle 42 of the inflator 4 with a hand to push and pull the push rod 421 to pump air into the hollow 411 of the cylinder 41 and to convey along the hollow 411 of the cylinder 41 toward the first opening 431, or operate the cylinder 41 through downward pressing or upward suction action, so that the air is compressed by the plug 422 and the air (shown by dotted arrows in FIG. 9 and FIG. 10) enters the drainage pipeline 6 from the space 523 and the third opening 527 of the pipe 521, the flexible pipe 52 and the plurality of layered flexible ring plates 522 are tightly sealed the inside of the drainage pipeline 6, and the disc 512 is abutted and sealed on the pipe opening 601 of the drainage pipeline 6 to avoid air leaking out from the drainage pipeline 6. As a result, the blockages 61 are disturbed forwards and backwards by the air to be looseness, and the blockages 61 are pressed toward an outlet of the drainage pipeline 6 by gravitational downward pressure of water which is originally existing inside the drainage pipeline 6, such that a dredging effect is achieved.

Figure 11:
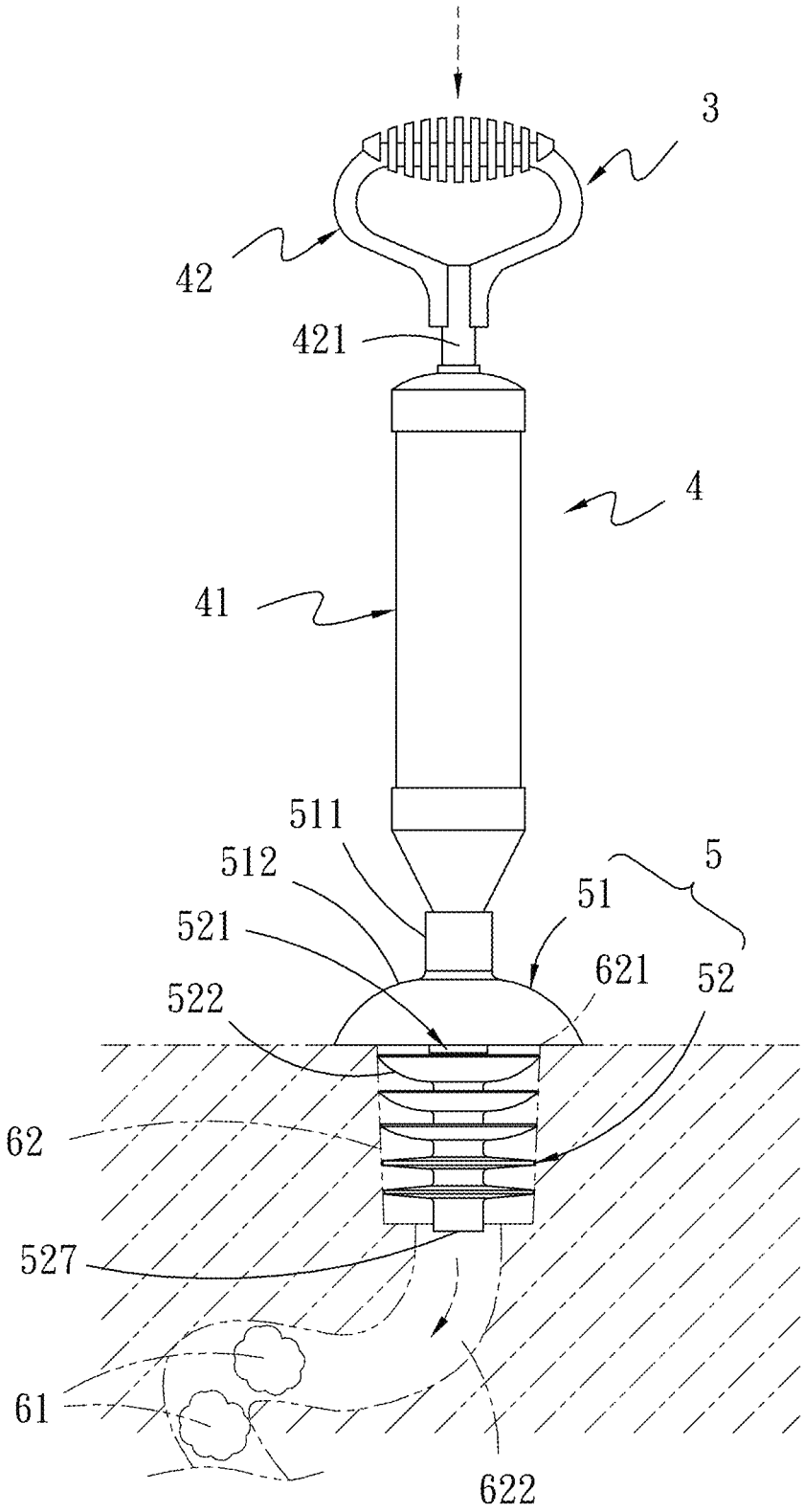
FIG. 11 is a schematic diagram of the reciprocating pump-type pipe dredging device of FIG. 6 dredging a water pipe with a large opening.

Please refer to FIG. 11 in conjunction with FIG. 9. The drainage pipeline 6 is, for example, a large opening water pipe 62. When the user uses the reciprocating pump-type pipe dredging device 3 to dredge or clear the blockages 61 in the large opening water pipe 62, the plurality of layered flexible ring plates 522 of the flexible pipe 52 are tightly sealed the inside of the large opening water pipe 62, and the disc 512 is abutted and sealed on a pipe opening 621 of the large opening water pipe 62. Then, the user may hold the inflator handle 42 of the inflator 4 with a hand to push and pull the push rod 421 to pump air into the hollow 411 of the cylinder 41 and to convey air along the hollow 411 of the cylinder 41 toward the first opening 431, or operate the cylinder 41 through downward pressing or upward suction action, so that the air is compressed by the plug 422 and the air (shown by dotted arrows in FIG. 9 and FIG. 11) enters a small drainage pipe 622 connected at an end of the water pipe 62 with large opening from the space 523 and the third opening 527 of the pipe 521, the flexible pipe 52 and the plurality of layered flexible ring plates 522 are tightly sealed the inside of the water pipe 62 with large opening, and the disc 512 is abutted and sealed on the pipe opening 621 of the water pipe 62 with large opening to avoid air leaking out from the water pipe 62 with large opening. As a result the blockages 61 are disturbed forwards and backwards by the air to be looseness, and the blockages 61 are pressed toward an outlet of the small drainage pipe 622 by gravitational downward pressure of water which is originally existing inside the small drainage pipe 622, so that a dredging effect is achieved.

Figure 12:
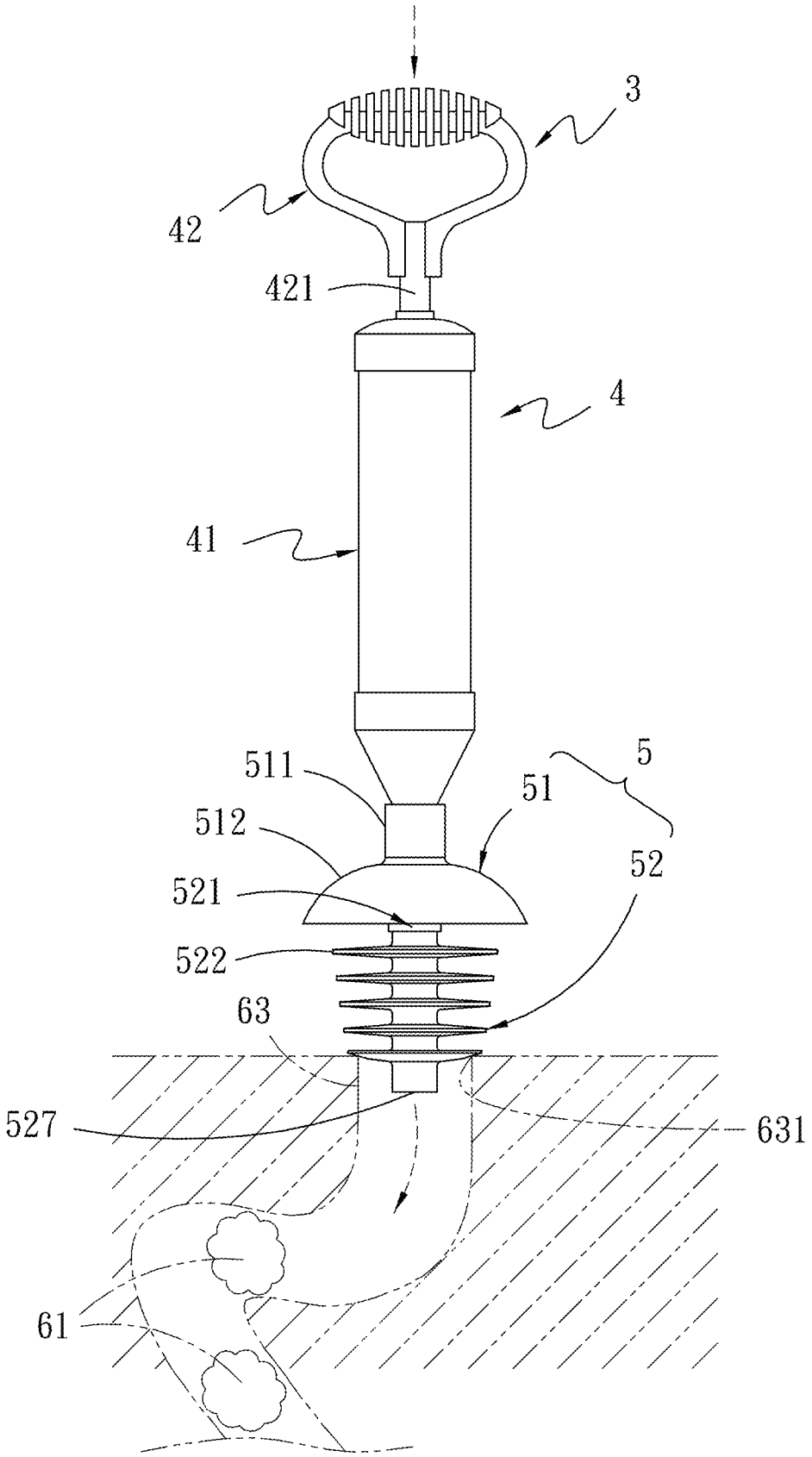
FIG. 12 is a schematic diagram of the reciprocating pump-type pipe dredging device of FIG. 6 dredging a small water pipe.

Please refer to FIG. 12 in conjunction with FIG. 9. The drainage pipeline 6 is, for example, a small water pipe 63. Firstly, one or two layers at a lowermost end of the plurality of layered flexible ring plates 522 are tightly sealed at a pipe opening 631 of the small water pipe 63. Then, the user may hold the inflator handle 42 of the inflator 4 with a hand to push and pull the push rod 421 to pump air into the hollow 411 of the cylinder 41 and to convey along the hollow 411 of the cylinder 41 toward the first opening 431, or operate the cylinder 41 through downward pressing or upward suction action, so that the air is compressed by the plug 422 and the air (shown by dotted arrows in FIG. 9 and FIG. 12) enters the small water pipe 63 from the space 523 and the third opening 527 of the pipe 521, the one or two layers at the lowermost end of the plurality of layered flexible ring plates 522 are tightly sealed at the pipe opening 631 of the small water pipe 63. As a result, the blockages 61 are disturbed forwards and backwards by the air to be looseness, and the blockages 61 are pressed toward an outlet of the small water pipe 63 by gravitational downward pressure of water which is originally existing inside the small water pipe 63, such that a dredging effect is achieved.

Figure 13:
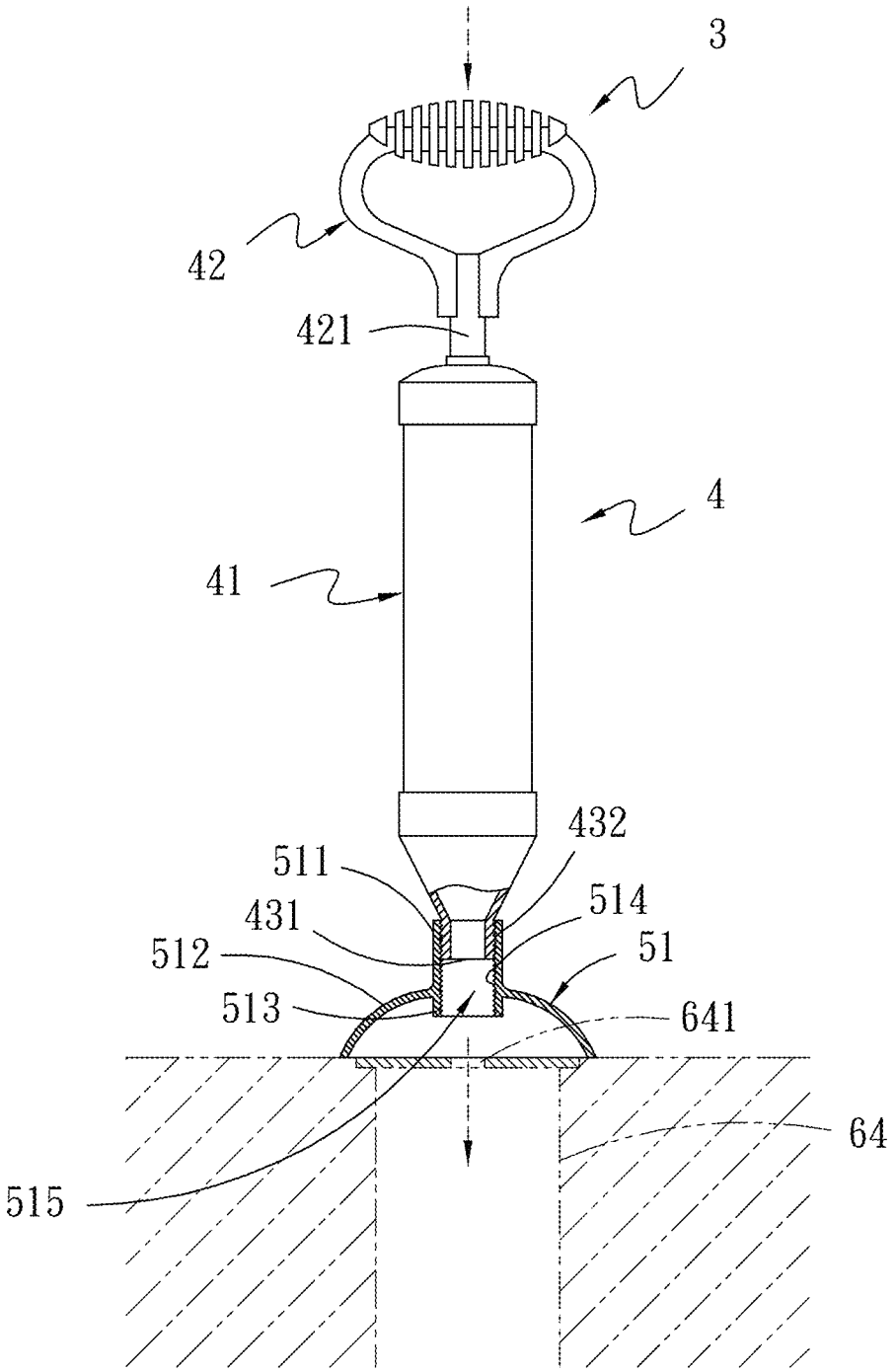
FIG. 13 is a schematic diagram of the reciprocating pump-type pipe dredging device of FIG. 6 dredging a water pipe with a small opening diameter in which a flexible pipe cannot be inserted into and only a suction disc can be used.

Please refer to FIG. 13. The drainage pipeline 6 is, for example, a small opening diameter water pipe 64. When the flexible pipe 52 of the reciprocating pump-type pipe dredging device 3 cannot be inserted into the small opening diameter water pipe 64, the user may firstly loose the external screw thread 526 of the fourth assembly portion 524 and the internal screw thread 514 of the third assembly portion 513 to separate the fourth assembly portion 524 from the third assembly portion 513 in order to remove the flexible pipe 52, and seal an outer periphery of a pipe opening 641 of the small opening diameter water pipe 64 via the disc 512 of the suction disc 51 only. Then, the user may hold the inflator handle 42 of the inflator 4 with a hand to push and pull the push rod 421 to pump air into the hollow 411 of the cylinder 41, air is conveyed along the hollow 411 of the cylinder 41 toward the first opening 431, or operate the cylinder 41 through downward pressing or upward suction action, so that the air (shown by a dotted arrow in FIG. 9) is compressed by the plug 422 and the air (shown by a dotted arrow in FIG. 13) enters the pipe opening 641 of the small opening diameter water pipe 64 from the passage 515 of the third assembly portion 513. As a result, the blockages 61 are disturbed forwards and backwards by the air to be looseness, and the blockages 61 are pressed toward an outlet of the small opening diameter water pipe 64 by gravitational downward pressure of water which is originally existing inside the small opening diameter water pipe 64, such that a dredging effect is achieved.

What is claimed is:

1. A reciprocating pump-type pipe dredging device comprising an inflator and a pipe dredging portion detachably assembled with the inflator, wherein:

the inflator comprises a cylinder with a hollow, an inflator handle connected to one end of the cylinder to push air into the hollow of the cylinder, and a first assembly portion disposed at one end of the cylinder opposite to the inflator handle, the first assembly portion is provided with a first opening communicating with the hollow of the cylinder; and the pipe dredging portion comprises a suction disc and a flexible pipe, wherein the suction disc comprises a second assembly portion joined with the first assembly portion, a disc connected to one end of the second assembly portion, a third assembly portion connected to the disc and corresponding to the second assembly portion, wherein the second assembly portion protrudes upward from the disc and the third assembly portion protrudes downward from the disc, a passage is formed between interiors of the second assembly portion and the third assembly portion, the flexible pipe comprises a pipe and a plurality of layered flexible ring plates, the pipe comprises a space and a fourth assembly portion corresponding to one end of the pipe and joined with the third assembly portion, the fourth assembly portion is provided with a second opening communicating with the space of the pipe, the second opening communicates with the passage and the first opening of the first assembly portion, the pipe is provided with a third opening at an end opposite to the second opening, and the third opening communicates with the space of the pipe and the second opening, thereby the inflator and the pipe dredging portion are formed with a continuous passage thereinside, and the plurality of layered flexible ring plates are disposed separately on an outer periphery of an end of the pipe and adjacent to the end of the pipe opposite to the fourth assembly portion.

2. The reciprocating pump-type pipe dredging device as claimed in claim 1, wherein an external screw thread is provided on an outer periphery of the first assembly portion, wherein an inner wall of the passage forms an internal screw thread to be correspondingly screwed with the external screw thread of the first assembly portion.

3. The reciprocating pump-type pipe dredging device as claimed in claim 2, wherein an outer periphery of the fourth assembly portion is provided with an external screw thread to be correspondingly screwed with the internal screw thread of the inner wall of the passage of the third assembly portion, so that the fourth assembly portion is connected and abutted with the first assembly portion.

4. The reciprocating pump-type pipe dredging device as claimed in claim 1, wherein outer diameters of the plurality of layered flexible ring plates are sequentially decreased layer by layer from an end of the pipe adjacent to the fourth assembly portion.

5. The reciprocating pump-type pipe dredging device as claimed in claim 4, wherein an outer diameter of the disc is larger than the outer diameters of the plurality of layered flexible ring plates.

* * * * *